United States Patent [19]

Onishi et al.

[11] 4,087,492

[45] May 2, 1978

[54] SLOW FUEL SUPPLY SYSTEM

[75] Inventors: Takanori Onishi; Osamu Kitahara, both of Toyota; Nobuo Shimizu, Ohbu; Takio Suzuki, Takahama; Tetsuo Yamashirodani, Higashiuramachi; Yozo Ohta, Chiryu, all of Japan

[73] Assignees: Toyota Jidosha Kogyo Kabushiki Kaisha, Toyota; Aisan Kogyo Kabushiki Kaisha, Ohbu, both of Japan

[21] Appl. No.: 764,175

[22] Filed: Jan. 31, 1977

[30] Foreign Application Priority Data

Nov. 2, 1976 Japan ..... 51-131956

[51] Int. Cl.[2] ..... F02M 3/08

[52] U.S. Cl. ..... 261/41 D; 261/DIG. 39; 261/121 B

[58] Field of Search ..... 261/41 D

[56] References Cited

U.S. PATENT DOCUMENTS

| | | | |
|---|---|---|---|
| 1,002,700 | 9/1911 | Jouffret et al. | 261/41 D |
| 1,759,498 | 5/1930 | Abrate | 261/41 D |
| 1,782,027 | 11/1930 | Boulade | 261/41 D |
| 1,820,825 | 8/1931 | Picard | 261/41 D |
| 2,737,935 | 3/1956 | Olson | 261/41 D |
| 3,168,077 | 2/1965 | Froede | 261/41 D |
| 3,288,446 | 11/1966 | Bimberg | 261/41 D |
| 3,693,947 | 9/1972 | Masaki et al. | 261/41 D |

*Primary Examiner*—Tim R. Miles

*Attorney, Agent, or Firm*—Stevens, Davis, Miller & Mosher

[57] ABSTRACT

A carburetor having a slow fuel passage extending to idle and slow ports, and a slow port plug inserted into said slow fuel passage and having a tip end which faces said slow port, oblique and axial bores formed therethrough, and an idle adjustment screw extending through said oblique bore.

2 Claims, 5 Drawing Figures

SLOW FUEL SUPPLY SYSTEM

BACKGROUND OF THE INVENTION

1. Field of the Invention:

The present invention relates to a carburetor for internal combustion engines and, more particularly, a slow fuel supply system incorporated in the carburetor for supplying fuel particularly during a slow speed or idling operation.

2. Description of the Prior Art:

In usual carburetors for automobile internal combustion engines, when the throttle valve is brought near to a full closed position for operating the engine at a slow speed or is brought to an idling opening position which is nearer to the full closed position for effecting an idling operation of the engine, almost no vacuum is generated in the venturi portion thereof and, accordingly, no substantial amount of fuel is drawn from the main nozzle. Because of this, the carburetor is provided with a slow port which opens adjacent an end of the throttle valve located at the idling opening position and an idle port which opens at a little downstream side of the slow port, whereby it is effected that a small amount of fuel is drawn out toward the intake passage by a vacuum generated in the small air stream which flows through a small clearance left between the end of the throttle valve and a wall portion of the intake passage where the slow port opens or an intake vacuum applied to the idle port.

In actual carburetors, an air bleed is incorporated in a fuel supply passage provided therein for provisionally mixing a proper amount of air into the stream of a liquid fuel such as gasoline flowing through the fuel passage and such an air bleed is also incorporated in the slow fuel supply system which supplied fuel to the aforementioned slow port and idle port. With respect to the air bleed, it is said that it is more effective to supply a less amount of air at more individual portions located along a fuel supply passage.

In a conventional slow fuel supply system having two air bleeds, a slow jet element and an economizer jet element, a stream of fuel is generated by the vacuum applied to the slow port and the idling port to flow through a slow fuel passage starting from a float chamber, passing through a metering portion in the slow jet element where the stream is metered and then being ejected from a fuel ejecting port of the slow jet element into a joining region of the slow fuel passage and a first air bleed so that the fuel is first mixed with air supplied from the first air bleed thereby producing a fuel-air mixture. This fuel-air mixture is then metered again when it passes through the economiser jet element, and, thereafter, is mixed with air supplied from a second air bleed and then the fuel-air mixture flows toward the slow port and the idle port. In the structure in which a slow port plug is inserted into a part of the slow fuel passage connecting to the slow port, the passage flow area of said part is reduced by the plug thereby effecting an increase of the flow speed of the fuel-air mixture which accelerates the atomization of the mixture and provides a good mixing condition of the mixture delivering from the slow port and the idle port.

Although a conventional carburetor of the aforementioned structure operates satisfactorily for the primary object of effecting a slow or idling operation, actually a fluctuation of about 100 r.p.m. in the rotational speed of the engine is unavoidable and, therefore, if it is sought to lower the idling rotational speed in view of the fuel economy or the exhaust gas emission, the above-mentioned fluctuation in the rotational speed of the engine becomes a serious problem which bars ensuring a stable idling operation of the engine.

Therefore, in order to obtain a stable idling operation at a very low rotational speed, there now exists a requirement for an improvement of the slow fuel supply system so that the fluctuation in the engine rotational speed at a very low speed rotation is minimised or, in other words, the fuel supply from the slow fuel system is more stabilized.

In view of the above mentioned situation, we have made experimental researches about the behavior of the fuel flowing through the slow fuel supply systems by employing visualized models and a high speed camera, expecting to obtain a precise knowledge of the above mentioned behavior of fuel. As a result, we have found that in a low speed operation or when the intake air flow rate is slow, the supply of fuel from the fuel ejecting port of the slow jet element to the joining portion of the fuel passage and the air bleed passage and the supply of fuel at the slow port are both made in an intermittent manner.

SUMMARY OF THE INVENTION

It is therefore the primary object of the present invention to provide a slow fuel supply system in which the fuel supply condition from the fuel ejecting port at the joining portion with the air bleed is improved so that a continuous and stable supply of fuel is effected at the fuel ejecting port.

In accordance with the present invention, the above-mentioned object is accomplished by a slow fuel supply system comprising a slow fuel passage extending from a float chamber to a slow port and and idle port, a slow air bleed passage joined to a middle portion of said flow fuel passage, and means for providing a fuel ejecting port incorporated in a region where said slow air bleed passage joins said slow fuel passage, said fuel ejecting port being provided at a central portion of the cross section of said slow air bleed passage to be traversed by a principal body of an air stream flowing through said slow air bleed passage.

By this arrangement, the fuel ejecting port is traversed by a relatively strong air stream even in a low speed or idling operation of the engine and the fuel is positively drawn out from the fuel ejecting port in a constant and stable manner without causing an intermittant flow of fuel at a middle portion of the slow fuel supply system. In order to provide the fuel ejecting port located at a central portion of the cross section of said slow air bleed passage, the means to provide the fuel ejecting port will definitely reduce the flow area around the fuel ejecting port, thereby causing an increase in the flow speed of the air which traverses the port, whereby the drawing action applied to the fuel existing in the fuel ejecting port is further intensified thereby generating a continous flow of fuel even in a low or idling operation.

In the idling operation, the fuel is principally supplied from the idle port but actually it is true that a small amount of fuel is supplied from the slow port even in the idling operation. Since the fuel drawn from the slow port into the intake passage is carried by a relatively swift stream of air flowing through a small clearance left between an edge portion of a throttle valve and a wall portion of the intake passage located around the slow port, the atomisation of this fuel is much better than that of the fuel supplied from the idle port. Therefore, it is contemplated that the stability of the idling operation will be improved by increasing the ratio of the fuel supplied from the slow port in the idling operation thereby accomplishing an improved atomization of fuel supplied to the engine operated in an idling condition.

In order to increase the ratio of the fuel supplied from the slow port in the idling operation, it may be contemplated to provide a larger slow port. However, since even a slight change in the shape of the slow port substantially affects the ratio of fuel supply divided between the idle port and the slow port, this method makes the design very difficult. If the ratio of fuel supplied from the slow port is made too large, the idle adjust screw is made ineffective in adjusting the air/fuel ratio in the idling operation and some disadvantageous effects such as run-on are caused.

Anoter object of the present invention is to provide an improved slow fuel supply system which incorporates, in addition to the aforementioned improvement with respect to the fuel ejecting port, a means for increasing the ratio of fuel supplied from the slow port in the idling operation without causing the aforementioned disadvantageous results so that the idling opeation of the engine is more stabilized by a better atomization of the fuel which is supplied to the slow port in the improved continous manner by the aforementioned improved fuel ejecting port.

This object is accomplished by the slow fuel supply system as mentioned above, further comprising a slow port plug inserted into said slow fuel passage with having a tip end which faces said slow port, said plug further having a substantially diametrical bore formed at a middle portion thereof, and an axial bore which connects a middle portion of said diametrical bore to said tip end, and an idle adjust screw having a shank portion which is mounted through said substantially diametrical bore.

By this arrangement, a part of the fuel flowing through a clearance left between said substantially diametrical bore and the plug is diverted toward the slow port through said axial bore to be drawn out from the slow port instead of being supplied from the idle port, thereby effecting the increase in the ratio of the fuel supplied from the slow port relative to the fuel supplied from the idle port.

BRIEF DESCRIPTION OF THE DRAWING

In the accompanying drawing.

DESCRIPTION OF THE PREFERRED EMBODIMENT

The invention will now be described in more detail with respect to preferred embodiments with reference to the accommpanying drawing.

Figure 1:
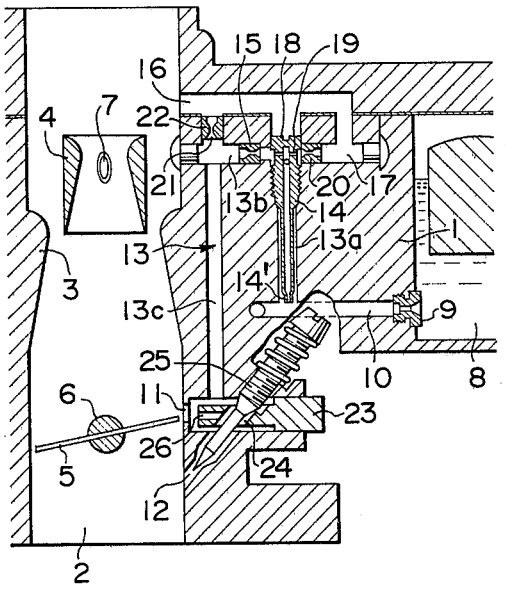
FIG. 1 is a somewhat diagrammatical sectional view showing an embodiment of a carburetor in which the slow fuel supply system of the present invention is incorporated.

Referring to FIG. 1. showing a carburetor in which the slow fuel supply system of the present invention is incorporated, 1 designates the body of the carburetor having an intake passage 2 formed therein. The intake passage includes a large venturi 3 provided at a middle portion thereof and a small venturi 4 provided at the throat portion of the large venturi. At the downstream side of the large venturi in the intake passage is provided a throttle valve 5 rotatably supported by a throttle valve shaft 6. A main nozzle 7 opens at the throat portion of the small venturi 4. The main nozzle is supplied with a fuel such as gasoline contained in the float chamber 8 through a main fuel passage 10 having a main jet 9 which meters the supply of fuel, although only a part of the main fuel passage 10 is shown in FIG. 1 without showing the full structure of the main fuel passage including a conventional well and air bleed passage for the purpose of simplicity of illustration, since the main fuel passage is not directly concerned with the present invention.

A slow port 11 is provided to open to the intake passage 2 at a position as shown in the figure or, in more detail, a position which is located upstream of the throttle valve 5 when it is set at the idling opening position and is located downstream of the throttle valve when it is slightly opened from the idling opening position. Further a little downstream of the slow port there opens an idle port 12. The slow port 11 and the idle port 12 are supplied with fuel through the main jet 9, the main fuel passage 10 and a slow fuel passage 13 diverted from a middle portion of the main fuel passage. The slow fuel passage 13 includes a slow jet element 14 and an economizer jet element 15, both being adapted to apply a metering action to the fuel supplied through the slow fuel supply system. In more detail, the slow fuel passage 13 includes a first vertical passage **13*a* having a lower end connected to a middle portion of the main fuel passage 10, a horizontal passage 13*b* which traverses and is connected with an upper end of the vertical passage 13*a* and a second vertical passage 13*c* which is connected to and is extended downward from an end portion of the horizontal passage 13*b*. The other end of the horizontal passage 13*b* is formed to be a first slow air bleed passage 17 connected with a bleed air intake port 16 which opens to the intake passage 2. In the region where the first vertical passage 13*a* and the horizontal passage 13*b* are connected with each other or where the first slow air bleed passage 17 is connected to the slow fuel passage 13, is incorporated a fuel ejecting port means 18 which, in the embodiment shown in FIG. 1, is an integral upper part of the slow jet element 14 mounted in the first vertical passage 13*a*. In this embodiment the slow jet element 14 is a tubular member having a closed upper end and a lower end portion formed to provide a conventional metering portion 14'. Adjacent the closed upper end are formed a plurality of (4 in the shown embodiment) fuel ejecting ports 19. As shown in the figure, the upper end portion of the slow jet element 14 extends to traverse the horizontal passage 13*b* and the fuel ejecting ports 19 are located at a central portion of the cross section of the air bleed passage 17. In the case of an ordinary carburetor for automobiles, the diameter of the port 19** should preferably be 0.7–1.5 mm and the number of the ports should preferably be 4–8.

By the provision of the fuel ejecting port means 18 in the manner to traverse the slow air bleed passage 17, the flow passage area in the region where the air bleed passage connects to the slow fuel passage 13 is locally reduced thereby temporarily increasing the air flow speed which traverses the fuel ejection ports 19, thereby applying an intensified drawing action to the fuel existing in the fuel ejection ports and also effecting a better atomization of the fuel ejected from the fuel ejecting ports. According to this fuel ejecting mechanism, a continous ejection of fuel is maintained at the fuel ejecting ports even when the amount of fuel supply is very low thereby enabling the slow port 11 or the idle port 12 to made a continous supply of well air-mixed fuel even in a slow speed or idling operation.

The first slow air bleed passage 17 is provided with a metering element 20 to apply a metering action to the bleed air supplied there-through. At a downstream portion of the economizer jet element 15 a second slow air bleed passage 21 having a metering element 22 is connected to the slow fuel passage.

In a region close to the slow port 11 the slow fuel passage 13 is enlarged, and in the enlarged portion a slow port plug 23 is inserted thereby providing a reduced effective flow passage area left between the passage bore and the plug. The slow port plug has a substantially diametrical bore 24 formed therein through which a shank portion of an idle adjust screw 25 for adjusting the opening of the idle port 12 is mounted. The bore 24 may be formed large enough to receive the shank portion of the idle adjust screw in consideration of an allowance in manufacture and easiness of assembly so that an annular space is definitely defined between the bore 24 and the shank portion. In idling operation, the drawing action applied by the intake vacuum to the idle port 12 causes a fuel flow through said annular space. According to the present invention, the slow port plug 23 has an additional bore 26 which extends from a middle portion of the substantially diametrical bore 24 to a tip end thereof which faces the slow port 11. By this arrangement, a part of the fuel flowing through said annular passage is diverted through the axial bore 26 toward the slow port in the idling operation thereby increasing the ratio of the fuel supplied from the slow port relative to the fuel supplied from the idle port. In an ordinary caburetor for automobiles, the diameter of the axial passage 26 should preferably be about 2mm.

Figure 2:
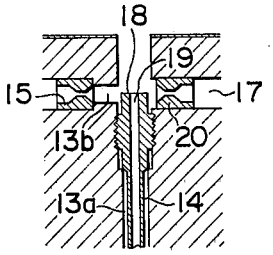
FIG. 2 is a fragmental sectional view showing an essential portion of another embodiment of the present invention.

FIG. 2 is a fragmental sectional view showing an essential portion of another embodiment of the present invention. In FIG. 2, the portions corresponding to those shown in FIG. 1 are designated by the same reference numerals. In this embodiment, the means 18 for providing the fuel ejecting port 19 is also provided by an upper integral part of the slow jet element 14. In this embodiment, however, the integral upper end of the slow jet element is formed to be an open tubular end located to project up to a central portion of the cross section of the slow air bleed passage 17, wherein the open end located at the central portion of the bleed air passage provides a fuel ejecting port 19. Also in this embodiment the fuel ejecting port 19 is traversed by a principal body of the bleed air stream flowing through the air bleed passage 17 and the same drawing and atomizing action as described with reference to the embodiment shown in FIG. 1, is applied to the fuel existing in the fuel ejecting port 19.

Figure 3:
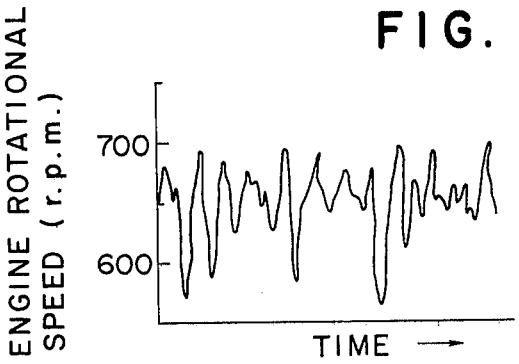
FIG. 3 is a graph showing fluctuations in the rotational speed of an engine which employs a conventional carburetor.
Figure 4:
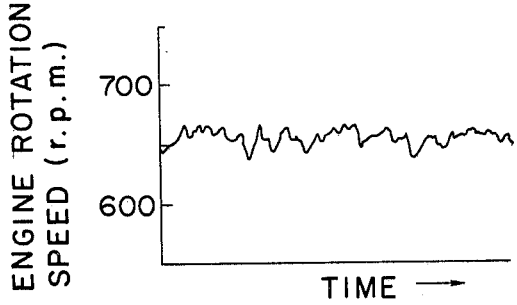
FIG. 4 is a graph showing fluctuations in the rotational speed of the same engine which employs a carburetor incorporating the present invention; and, FIG. 5 is a graph showing the emission of hydrocarbon from engines, one employing a conventional carburetor while the other employs a carburetor incorporating the present invention.
Figure 5:
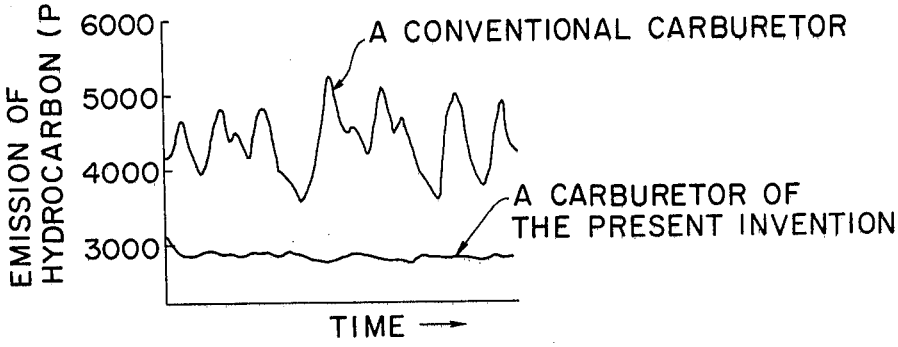

In FIGS. 3–5, the graphs show how the present invention improves the stability of idling operation in engines.

FIG. 3 shows fluctuations in the rotational speed of an engine employing a conventional carburetor. When the rotational speed is very low such as in the range 600–700 r.p.m. the rotation is very unstable to fluctuate so much as 100 r.p.m. or more.

FIG. 4 is a graph similar to FIG. 3, showing the performance of the same engine as in FIG. 3 which, however, employs a carburetor in which the improved fuel ejecting port structure and slow port plug as explained above are incorporated. A comparison of FIGS. 3 and 4 will apparently show the effect of the present invention.

FIG. 5 shows another comparison of a conventional carburetor and a novel carburetor incorporating the present invention with respect to the emission of hydrocarbon from the engine employing these carburetors. The reduction in the emission of hydrocarbon by the present invention is accomplished by an improved combustion of fuel due to a continous and stable supply of fuel in a well atomized condition. The reduction in the hydrocarbon emission is very advantageous when automobiles are equipped with catalytic converters in view of the heat generation in the converter. Furthermore, the improvement in the stability of idling operation allows the engine to operate at a higher air/fuel ratio thereby providing an additional advantage that the emission of uncombusted components is further reduced.

Although the invention has been described with reference to some particular embodiments thereof, it is to be noted by those skilled in the art that various modifications with respect to the shown embodiments will be made without departing from the spirit of the invention.

We claim:

1. In a carburetor system having an intake passage, a throttle valve located in said intake passage, a float chamber, an idle port which is located in said intake passage at a position which is absolutely downstream of said throttle valve, and a slow port which is located in said intake passage at a position which is upstream of said throttle valve when it is set in the fully closed position and is located downstream of said throttle valve when it is slightly opened from the fully closed position, the improvement comprising a slow fuel passage extending from said float chamber to said idle and slow ports, and a slow port plug inserted into said slow fuel passage and having a tip end which faces said slow port, said plug having an oblique bore formed at a middle portion thereof and an axial bore which connects a middle portion of said oblique bore to said tip end, and an idle adjusting screw having a shank portion mounted through said oblique bore.

2. The system of claim 1, wherein said oblique bore has a diameter large enough to receive said shank portion and definitely to define an annular passage therebetween in spite of the tolerances of manufacture and assembly.

* * * * *